United States Patent [19]

Sabatini

[11] Patent Number: 4,645,185

[45] Date of Patent: Feb. 24, 1987

[54] DEVICE FOR COOLING HOT-ROLLED FLAT PRODUCTS

[75] Inventor: Bruno Sabatini, Nemi, Italy

[73] Assignee: Centro Sperimentale Metallurgico S.p.A., Rome, Italy

[21] Appl. No.: 748,609

[22] Filed: Jun. 25, 1985

[30] Foreign Application Priority Data

Jul. 4, 1984 [IT] Italy ..... 48502 A/84

[51] Int. Cl.[4] ..... C21D 1/62

[52] U.S. Cl. ..... 266/114; 266/259; 72/201

[58] Field of Search ..... 72/201; 266/111–114, 266/117, 259; 134/122 R

[56] References Cited

U.S. PATENT DOCUMENTS

| | | | |
|---|---|---|---|
| 2,211,981 | 8/1940 | McBain et al. | 72/201 |
| 4,440,584 | 4/1984 | Takeshige et al. | 148/128 |
| 4,488,710 | 12/1984 | Greenberger | 266/114 |

FOREIGN PATENT DOCUMENTS

| | | | |
|---|---|---|---|
| 88921 | 6/1980 | Japan | 72/201 |
| 41317 | 3/1982 | Japan | 148/143 |

*Primary Examiner*—Christopher W. Brody

*Attorney, Agent, or Firm*—Young & Thompson

[57] ABSTRACT

A device for cooling hot rolled flat products in such a way so to deliver to the product a relatively long, very thin, low turbulence blade of water which can be adjusted as to flow rate transversely of the product and so can adjust the cooling conditions of the product transversely of the product. The device comprises an elongated water delivery chamber having a linear slit that extends across the product to be cooled. The chamber is bounded longitudinally by guide walls that converge toward the slit and is divided transversely into a plurality of smaller chambers by a plurality of baffles transverse to the length of the chamber. Each of the smaller chambers is in communication with the water supply via at least one adjustable flow regulating device. The baffles are integral with the walls of the chamber and terminate toward the slit short of the outer edge of the slit.

1 Claim, 4 Drawing Figures

DEVICE FOR COOLING HOT-ROLLED FLAT PRODUCTS

DESCRIPTION

The present invention relates to devices for cooling hot-rolled flat products. More precisely it concerns a structural alteration to such devices (of the type that delivers a thin jet of low-turbulence water in the form of a blade extending across the entire width of the cooling bed), so as to enable variations to be made in the quantity of water across the whole width of the cooling bed, thus modifying the cooling capacity as well as the width of the cooling bed itself.

The known devices for cooling hot-rolled flat products can be divided into two basic groups: one includes those which deliver the cooling water in jets whose width is limited compared with that of the cooling bed; these are devices with sprays or small section cylindrical laminar jets. Generally the cooling efficiency of such jets or sprays is relatively limited, so a great number must be installed, thus necessitating a considerable amount of space; furthermore, even though it is easy to deliver the water via a great number of jets, they can only be controlled in a full-on or full-off manner, so the possibility of adjusting cooling capacity is relatively limited, not least because of their low efficiency.

The other group includes devices which deliver water as a thin curtain right across the cooling bed; these are usually referred to as laminar jets but in actual fact their flow is turbulent, albeit not excessively. The cooling efficiency of such devices is excellent, yet despite a number of suggestions known at the present state of the art, their drawback is that the quantity of water delivered cannot be regulated simply and efficiently across the width of the cooling bed.

In the case of hot-rolled flat product, namely plate and strip, the possibility of precise control of temperature reduction both along and across the width of the bed, is coming to be a matter or prime importance for ensuring the necessary uniformity of cooling and the consequent homogeneity of product structure and flatness, so as to eliminate or at least reduce costly post-rolling heat and mechanical treatment operations (e.g. flattening).

This differential cooling is of particular importance in the case of plate, where the formation of uneven temperatures tends to be more marked owing mainly to the unfavourable area-volume ratio of the piece which results in more rapid cooling on the edges.

So far there exist no devices that can ensure simple, effective continuous variation in the amount of cooling across the width of the rolled product. The object of this invention is to remedy this unfortunate situation by making available an improved device incorporating a broad range of control of water flow not only in absolute terms but also along the entire length of said device.

According to the present invention, a device for cooling hot-rolled flat products, equipped with means for the supply of water and with a chamber for delivery of the water which has a linear slit parallel to the rolling plane, through which a jet of water in the form of a long, very thin, low-turbulence blade is directed onto the plate or strip, is modified in that the water-jet generation chamber is separated from said means of cooling water supply, is longitudinally delimited by walls that converge towards the water-jet delivery slit and is transversely divided into a number of smaller chambers by baffles set transverse to the length of the device itself. The baffles are fixed to the walls of the water-jet generation chamber and terminate towards the jet delivery slit just before the external edge of the slit. Each of the smaller chambers into which the water-jet generation chamber is divided is in communication with said means of water supply through at least one device complete with flow variator.

In this manner, each of the smaller chambers delivers its own water jet whose flow is that needed for the desired cooling. Adjacent water jets come together again within the device at some distance from the delivery slit so as to avoid separation of the various streams and in such a manner that the terminal part of the walls converging towards the slit render the flow linear. A single jet having different flow rates across the width of the cooling bed is thus created.

Regulation of the flows delivered by each of the small chambers is achieved quite simply by varying the setting of the devices connecting said chambers to said means of water supply.

The present invention will now be described in greater detail in relation to its embodiments which are set forth here purely by way of exemplification and are in no respect to be construed as restrictive in relation to the enclosed drawings where:

Figure 1:
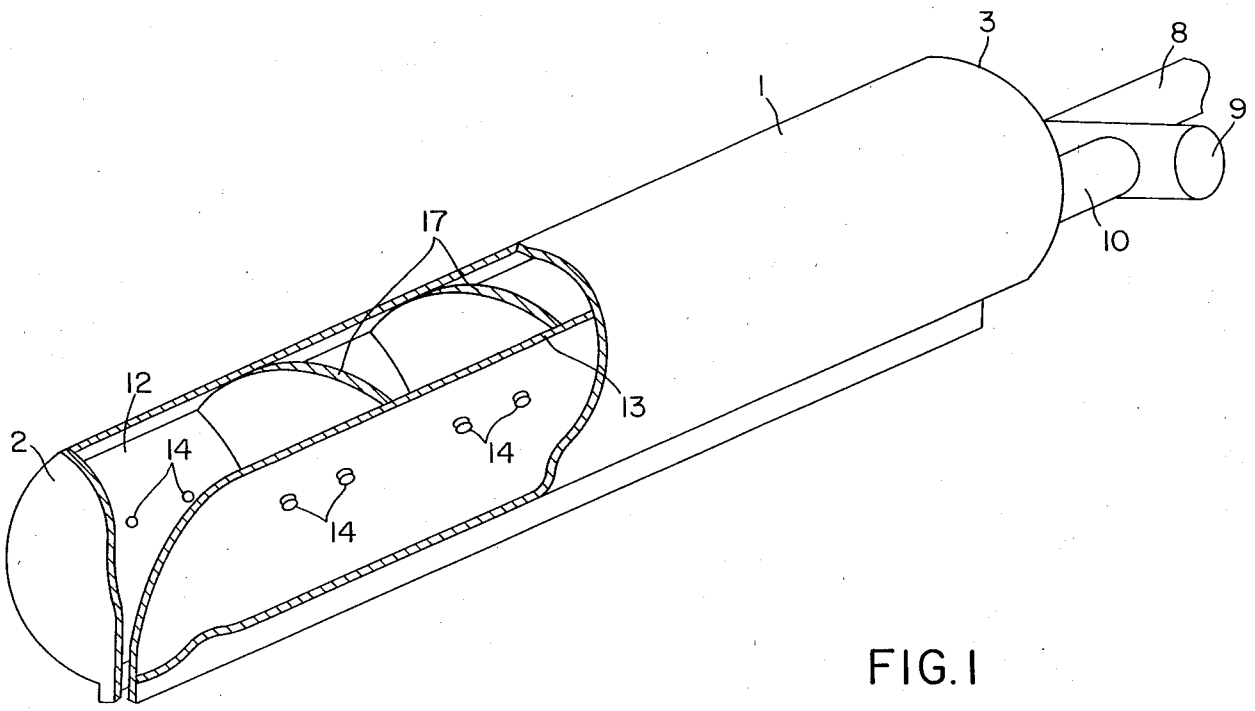
FIG. 1 is a part cutaway perspective view of an improved device as per this invention
Figure 2:
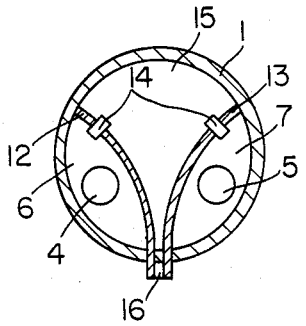
FIG. 2 is a vertical cross section of FIG. 1
Figure 3:
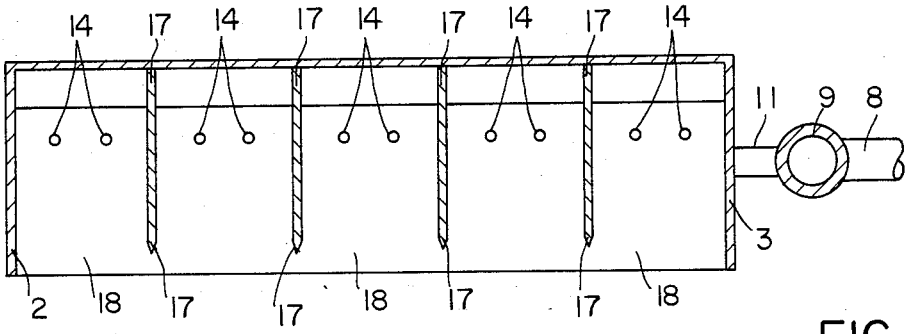
FIG. 3 is a vertical section of FIG. 1 on plane A—A of FIG. 2

With reference to FIGS. 1 to 3, the device as per this invention consists of an outer casing 1 of elongated form, closed at both ends by walls 2 and 3. Wall 3 has passages 4 and 5 for the supply of water to the inside of the device, namely to chambers 6 and 7; the water is led to the device by manifold 8 and distributed to chambers 6 and 7 via distributor 9 and tubes 10 and 11, connected to passages 5 and 4, respectively.

Chambers 6 and 7 are created by the walls of the casing 1 and by internal guide walls 12 and 13 respectively, integral with the walls of casing 1 and the end walls 2 and 3. Internal guide-walls 12 and 13 enclose a chamber 15, further bounded by part of the wall of casing 1 and communicating with the outside via opening 16, which runs lengthwise right along the device, being formed by the lips of guide-walls 12 and 13.

Chamber 15 is divided, transversely, by a number of baffles 17, which form a number of smaller chambers 18, separate from one another and non-communicating except at a small distance from the slit 16; in fact, said baffles 17 terminate inside chamber 15 a short way before slit 16 with a tapered edge 17' (see FIG. 3).

Guide-walls 12 and 13 have a number of passages 14 which bring chambers 6 and 7 into communication with chamber 15, so that each of the smaller chambers 18 created inside chamber 15 by baffles 17 is in communication with chambers 6 and 7.

Passages 14 are fitted with known means for varying the size of the openings, so as to be able to alter the flow of cooling water which passes from chambers 6 and 7 to the smaller chambers 18.

In operation, the cooling water, led from manifold 8 and distributed to chambers 6 and 7 by means of distributor 9 and tubes 10 and 11, fills these chambers and from there moves through passages 14 to fill the smaller chambers 18. Here turbulence is greatly reduced and, at the extreme, flow becomes laminar owing to the shape and the proportions of the dimensions of the guide-walls 12 and 13 and the smaller chambers 18. The water then flows through slit 16 towards the plate to be cooled.

Baffles 17 terminate with a tapered edge 17' a short way before slit 16, so that the various streams delivered by the individual smaller chambers 18 join to form a single continuous blade of water whose thickness is very small compared with its length and whose turbulence is very low.

The configuration described is especially suitable for those cases involving very simple, mechanical flow-variation devices such as drilled slides which can be moved to close the waterway passages to a greater or lesser extent.

When it is desirable to install more sophisticated flow variators such as electric valves of the on-off type or of the type that can be opened and closed gradually, a configuration such as that in FIGS. 1 and 2 is not to be recommended, primarily because of the difficulty of monitoring and servicing the flow-variation devices that are not very accessible.

Figure 4:
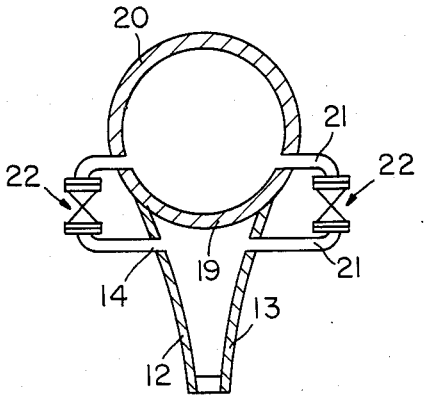
FIG. 4 is a vertical cross section of a device different from that of FIG. 1, but which functions on the same principle.

In this case it is far more preferable to adopt a configuration which provides for the valves to be mounted outside the device, such as the arrangement illustrated in cross-section in FIG. 4. In this configuration, guide-walls 12 and 13 not only direct the streams to form the blade of water, they also form the outer wall of the device, together with wall 19, on which is carried water-supply conduit 20. Branches 21 take off from this conduit and connect to passages 14. These branches have valves 22 for regulating the flow of water.

By means of the present invention the flow of water delivered by each of the smaller chambers 18 can be regulated easily and it is also possible to obtain a blade of water formed by the individual streams delivered by the various smaller chambers 18. This blade of water is compact and has a rate of flow which is variable from the edge to the centre.

Depending on the cross-sectional dimensions of the rolling mill and its cooling requirements, the number of smaller chambers 18 and the size of the slit 16 can be modified appropriately to ensure very fine control of the flows that is quite impossible with known devices, while maintaining the high cooling efficiency typical of such devices.

Pilot-scale tests show that two adjacent smaller chambers 18 can deliver water flows which differ by at least 33 percent without any deterioration in the compactness and efficiency of the blade of water as a whole.

Owing to constructional limitations of the pilot-scale device it has not yet been possible to move beyond the experimental stage.

I claim:

1. In a device for cooling hot-rolled flat products, provided with means for the supply of water and with an elongated water-delivery chamber which extends transverse to the length of the product and which has a linear slit, perpendicular to the direction of movement of the product to be cooled, through which a jet of water in the form of a relatively long, very thin, low-turbulence blade is directed onto the product; the improvement in which the water delivery chamber is separated from said water supply means, said chamber is bounded longitudinally by guide walls converging toward the water-jet delivery slit and is divided transversely into a plurality of smaller chambers by a plurality of baffles transverse to the length of said chamber, each of said smaller chambers being in communication with said water-supply means via at least one device having a flow variator, said baffles being integral with the walls of said chamber and terminating toward said water-jet delivery slit short of the outer edge of said slit.

* * * * *